US009516415B2

(12) United States Patent
Nielsen

(10) Patent No.: US 9,516,415 B2
(45) Date of Patent: Dec. 6, 2016

(54) DOUBLE BACKPLATE MEMS MICROPHONE WITH A SINGLE-ENDED AMPLIFIER INPUT PORT

(75) Inventor: Ivan Riis Nielsen, Stenløse (DK)

(73) Assignee: Epcos AG, München (DE)

( * ) Notice: Subject to any disclaimer, the term of this patent is extended or adjusted under 35 U.S.C. 154(b) by 232 days.

(21) Appl. No.: 14/357,930

(22) PCT Filed: Dec. 9, 2011

(86) PCT No.: PCT/EP2011/072342
§ 371 (c)(1),
(2), (4) Date: Sep. 3, 2014

(87) PCT Pub. No.: WO2013/083203
PCT Pub. Date: Jun. 13, 2013

(65) Prior Publication Data
US 2014/0376749 A1 Dec. 25, 2014

(51) Int. Cl.
*H04R 3/00* (2006.01)
*H04R 3/04* (2006.01)
*H04R 19/00* (2006.01)

(52) U.S. Cl.
CPC ..... *H04R 3/04* (2013.01); *H04R 19/005* (2013.01)

(58) Field of Classification Search
CPC ..... H04R 3/04; H04R 19/005
See application file for complete search history.

(56) References Cited

U.S. PATENT DOCUMENTS

| | | | |
|---|---|---|---|
| 4,491,697 | A | 1/1985 | Tanaka et al. |
| 2010/0326258 | A1 | 12/2010 | Masaki et al. |

FOREIGN PATENT DOCUMENTS

| | | | |
|---|---|---|---|
| DE | 2155026 | A1 | 5/1973 |
| EP | 0065746 | A2 | 1/1982 |
| JP | 57-193198 | A | 11/1982 |
| JP | 2009-517940 | A | 4/2009 |
| JP | 2011-008187 | A | 1/2011 |
| JP | 2011-193342 | A | 9/2011 |
| JP | 2014-506412 | A | 3/2014 |
| WO | 2007/062975 | A1 | 6/2007 |
| WO | 2011/114398 | A1 | 9/2011 |

OTHER PUBLICATIONS

International Preliminary Report on Patentability corresponding to International Patent Application Serial No. PCT/EP2011/072342, The International Bureau of WIPO, dated Jun. 10, 2014; (5 pages).
International Search Report corresponding to co-pending Internatioanl Patent Application Serial No. PCT/EP2011/072342, European Patent Office, dated Jun. 8, 2012; (3 pages).
Jesper B. et al.: "Micromachined double backplate differential capacitive microphone" Journal of Micromechanics & Microengineering, Institute of Physics Publishing, Bristol, GB, vol. 9, No. 1, Mar. 15, 1999, pp. 30-33, XP020069238.
Kadirvel K. et al.: "Design, Modeling and Simulation of a Closed-Loop Controller for a Dual Backplate MEMS Capacitive Microphone" IEEE Sensors 2007, Conference, PI, Oct. 28, 2007, pp. 87-90, XP031221002.

*Primary Examiner* — Regina N Holder
(74) *Attorney, Agent, or Firm* — Nixon Peabody LLP

(57) ABSTRACT

A double backplate microphone having a good signal-to-noise ratio and being produceable at reduced manufacturing costs is provided. A microphone comprises a first backplate BP1, a second backplate BP2 and a membrane M. The microphone further comprises an amplifier AMP with a single-ended input port. The first backplate BP1 is electrically connected to the single-ended input port.

8 Claims, 2 Drawing Sheets

DOUBLE BACKPLATE MEMS MICROPHONE WITH A SINGLE-ENDED AMPLIFIER INPUT PORT

CROSS-REFERENCE TO RELATED APPLICATIONS

This application is a U.S. National Stage of International Application No. PCT/EP2011/072342, filed Dec. 9, 2011, all of which is incorporated herein by reference in its entirety.

The present invention refers to double backplate microphones comprising an amplifier having a single-ended input port.

Simple MEMS microphones comprise one backplate and one membrane establishing a capacitor to which a bias voltage is applied. Acoustic sound stimulates oscillation of the membrane. Thus, the sound signals can be converted into electrical signals by evaluating the capacitance of the capacitor. Therefore, the membrane or the backplate is electrically connected to an amplifier while the respective other electrode of the capacitor is electrically connected to a fixed potential. Accordingly, amplifier having a single-ended input port is needed.

It is an object of the present invention to provide a MEMS microphone having an improved signal-to-noise ratio. It is a further object to provide a MEMS microphone being produceable at low manufacturing costs. It is a third object to provide a MEMS microphone having a low current consumption.

For that, independent claim 1 provides a double backplate MEMS microphone having a good signal-to-noise ratio, being produceable at low manufacturing costs and having a low current consumption.

A MEMS microphone comprises a first backplate and a second backplate being electrically connected to ground. The microphone further comprises a membrane being arranged between the first and the second backplate, and an amplifier with a single-ended input port. The first backplate is electrically connected to the single-ended input port.

Thus, a double backplate microphone is provided. A bias voltage can be applied to the membrane while the first and the second backplate are DC-wise biased to a fixed potential. A signal from the first backplate and a signal from the second backplate, both comprising the acoustical signal converted into an electrical form, are added in phase resulting in a better signal-to-noise ration compared to single backplate microphones.

However, in contrast to conventional double backplate microphones, an amplifier having a single-ended input port is utilized to amplify the electrical signals. Conventional double backplate microphones utilize an amplifier having a balanced input port, e.g. an input port with two signal connections receiving electrical signals of opposite polarity but similar absolute values. Amplifiers comprising a single-ended input port instead of a balanced input port are produceable at a lower price. Thus, MEMS microphones comprising these simpler amplifiers are produceable at lower manufacturing costs and have a low current consumption, too. Such microphones provide lower manufacturing costs compared to conventional double backplate microphones and a better signal-to-noise ratio compared to single backplate microphones.

The distance between the membrane and the respective backplate can be 2 μm.

In one embodiment, the double backplate microphone further comprises a first resistive element having a resistivity between 1 GΩ and 1000 GΩ, e.g. 100 GΩ. The first resistive element is electrically connected to the first backplate. Via the first resistive element, the first backplate can be biased relative to the second backplate being electrically connected to ground. The first backplate and the membrane establish electrodes of a first capacitor. The membrane and the second backplate establish electrodes of a second capacitor being electrically connected in series to the first capacitor. Thus, the series connection of the first capacitor and the second capacitor is biased via the first resistive element. The series connection of the first capacitor and the second capacitor can establish a capacitance element of variable capacitance. When the capacitance of one capacitor increases the capacitance of the respective other capacitor decreases, and vice versa. Thus, The signal voltages from the first capacitor and the second capacitor add in phase.

Only a single-ended output port of the capacitance element is needed to electrically connect the capacitance element with an amplifying circuit comprising the amplifier having the single-ended input port. Thus, the membrane can DC-wise be tied to a specific potential or AC-wise be floating.

In one embodiment, the double backplate microphone further comprises a second resistive element having a resistivity between 1 GΩ and 1000 GΩ, e.g. 100 GΩ. The second resistive element is electrically connected to the membrane. Thus, the potential of the membrane can be adjusted individually.

The resistivity elements can be realized as diodes being electrically connected in parallel but with opposite polarity.

In conventional double backplate microphones, three signal ports are needed to electrically connect the capacitance element with an external circuit environment: the first backplate is electrically connected to the first input port of the amplifier, the second backplate is electrically connected to the second balanced port of the amplifier, and the membrane is electrically connected to a voltage source providing the membrane potential. However, in this embodiment, only two signal ports are needed to electrically connect the capacitance element with an external circuit environment.

In one embodiment, the membrane is biased with a voltage between 5 V and 15 V , e.g. 10 V, relative to the ground potential. The second backplate is electrically connected to ground.

In one embodiment, the first backplate is biased with a voltage between −2 V and +2 V.

In one embodiment, the amplifier is a low noise amplifier.

In one embodiment, the double backplate microphone further comprises a carrier substrate, a MEMS chip, and an IC chip. The first backplate, the membrane, and the second backplate are arranged within the MEMS chip. The amplifier comprises amplifier circuits being arranged in the IC chip. The MEMS chip and the IC chip are arranged on the carrier substrate.

As the capacitance element comprising the first capacitor and the second capacitor is electrically connected to the amplifier only via the first backplate, only a single signal line is needed to electrically connect the MEMS chip carrying the capacitors and the IC chip carrying the amplifier's integrated circuits.

In one embodiment, the double backplate microphone comprises the first and the second resistive element which may be realized as SMD components being arranged on the carrier substrate or which are established as circuit elements within the IC chip.

In one embodiment the microphone comprises a MEMS-chip, where the first backplate, the membrane, and the second backplate are arranged on the MEMS-chip and the amplifier comprises amplifier circuits arranged in the MEMS-chip. Such a chip can be a Silicon chip.

In one embodiment, the IC chip is an ASIC (Application-Specific Integrated Circuit) chip.

The basic principle and schematic embodiments further explaining the invention are shown in the figures.

SHORT DESCRIPTION OF THE FIGURES

DETAILED DESCRIPTION

Figure 1:
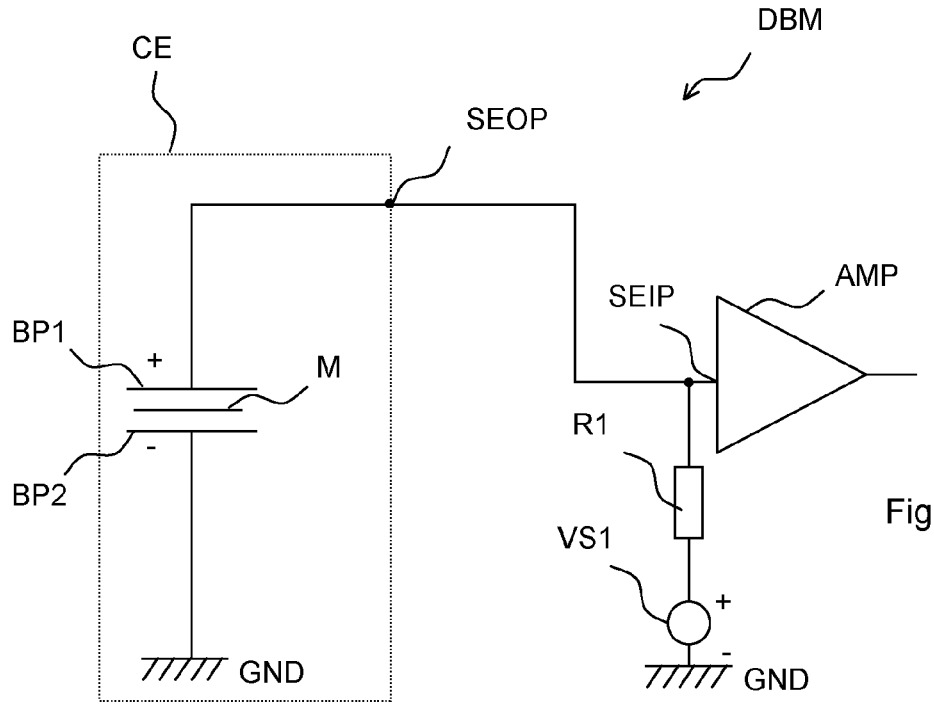
FIG. 1 shows an equivalent circuit diagram of a basic embodiment.

FIG. 1 shows an equivalent circuit diagram of a MEMS microphone DBM comprising a first backplate BP1 and a second backplate BP2. A membrane M is arranged between the first backplate BP1 and the second backplate BP2. The second backplate BP2 is electrically connected to ground GND. The first backplate BP1 is electrically connected to a single-ended input port SEIP of an amplifier AMP. The first backplate BP1 and the membrane M establish the electrodes of the first capacitor (C1 in FIG. 2). The membrane M and the backplate BP2 establish the electrodes of the second capacitor (C2 in FIG. 2). The series connection of the first capacitor and the second capacitor establish a capacitance element CE having a variable capacity where the capacity varies in time depending on the received sound pressure. Only a single-ended output port SEOP is needed to electrically connect the capacitance element CE with the single-ended input port SEIP of the amplifier AMP. For that, a signal line electrically connecting the single-ended output port SEOP and the single-ended input port SEIP can be provided, e.g. as a metallization. The first backplate BP1 is biased with a first voltage V1 via a first voltage source VS1 and a first resistive element R1. For that, the first resistive element R1 is electrically connected to the single-ended output port SEOP of the capacitance element CE and the single-ended input port SEIP of the amplifier AMP, respectively.

Thus, a MEMS microphone is provided that has a good signal-to-noise ratio due to the double backplate construction and that allows low manufacturing costs due to utilizing an amplifier having a single-ended input port only.

Figure 2:
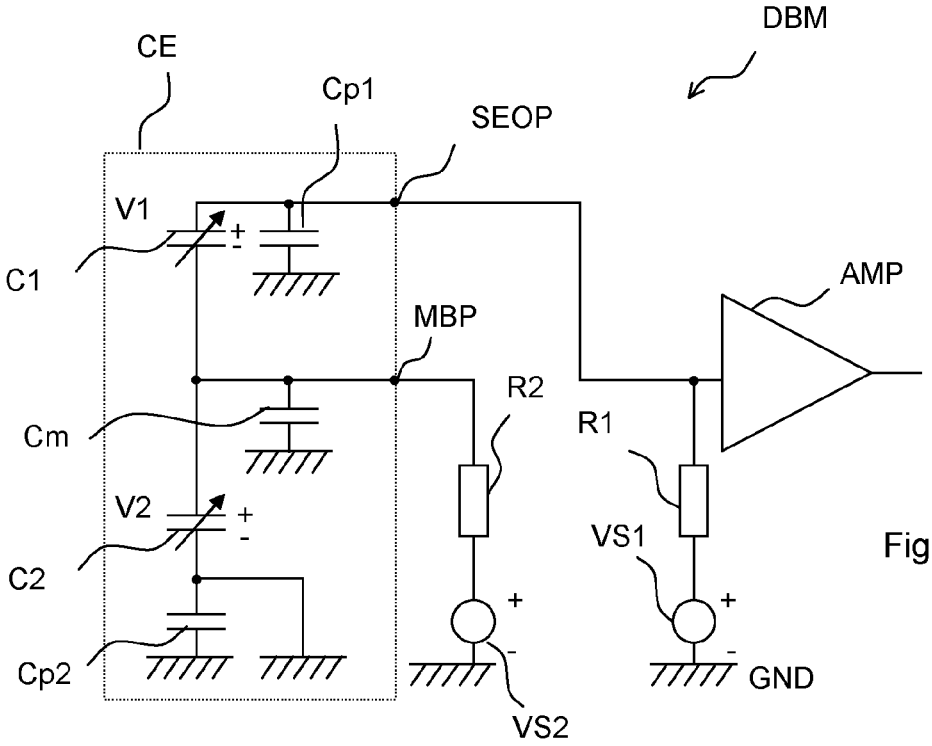
FIG. 2 shows an equivalent circuit diagram of a more sophisticated MEMS microphone.

FIG. 2 shows an embodiment of the double backplate MEMS microphone DBM comprising further circuit elements. The first backplate BP1 and the membrane of FIG. 1 are schematically drawn as the first capacitor C1. The second backplate BP2 and the membrane M are schematically drawn as the second capacitor C2. The membrane is biased by a second voltage source VS2 via a second resistive element R2. For that, the second resistive element R2 is electrically connected to a membrane biasing port MBP.

The voltage source can be realized as charge pumps.

The second backplate BP2 is connected to ground GND and the first backplate BP1 is connected to the amplifier input. The signal from the second backplate and the signal from the first backplate are added in phase. In order for the voltage V2 not to be shorted out, the membrane is biased via the second resistive element, e.g. via a very high impedance network.

In contrast to conventional double backplate microphones, the parasitic capacitance between the membrane and ground is not irrelevant anymore. Thus, this capacitance has to be minimized.

An intrinsic parasitic capacitance between the first backplate BP1 and ground is denoted as Cp1. An intrinsic parasitic capacitance between the membrane M and ground is labeled Cm. An intrinsic parasitic capacitance between the second backplate BP2 and ground is labeled Cp2. In an equilibrium state—i.e. no sound signals are received—, the first capacitor C1 and the second capacitor C2 can have a capacitance between 4 pF and 8 pF, e.g. 6 pF. The parasitic capacitance between the first backplate BP1 and ground, Cp1, can have a value of 0.1*C1. The parasitic capacitance between the second backplate BP2 and ground, CP2, can have a value of 0.5*C1. The parasitic capacitance between the membrane M and ground, Cm, can have a value of approximately 0.5*C1. The sensing voltage Vsens is defined as the sum of V1 and V2. The effective sensing voltage in which the parasitic capacitances are considered is:

$$V\text{sens}_{eff}=(C2/(C2+Cm)*V1+V2)*(C1*(C2+Cm))/(C1*(C2+Cm)+(C2+C1+Cm)*Cp1) \quad (1)$$

Thus, $\text{Vsens}_{eff}$=0.714*Vsens. The effective sensing voltage is reduced by a factor of 0.714.

Figure 3:
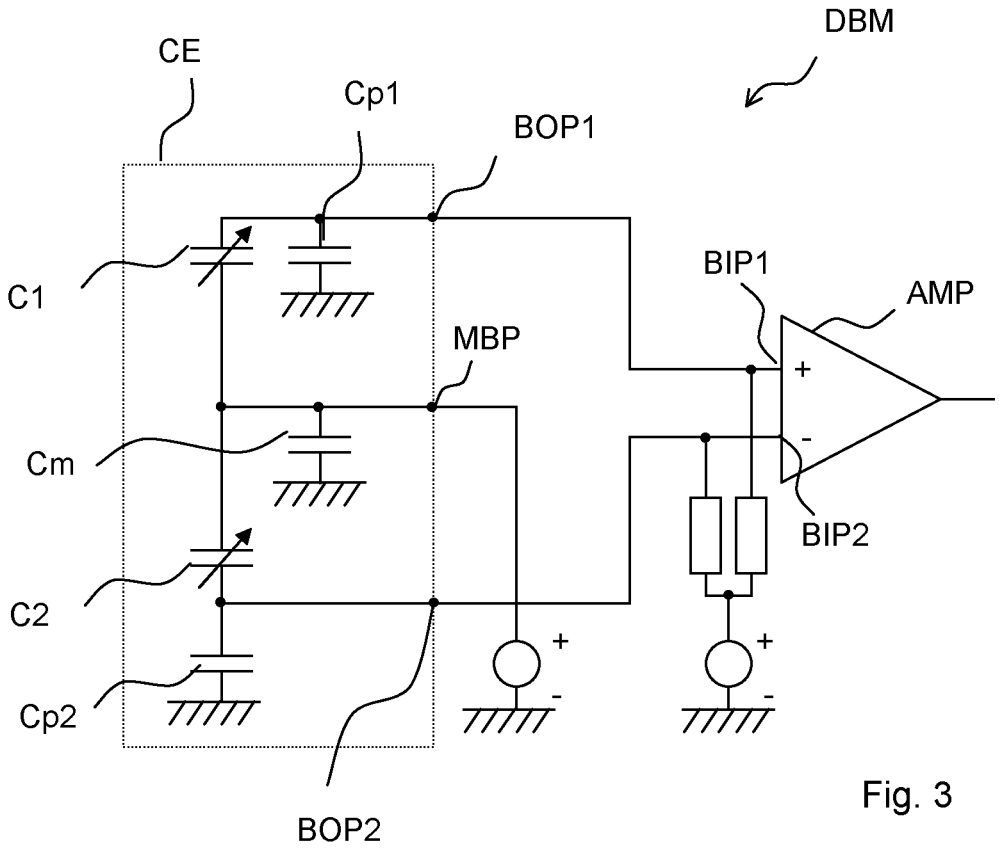
FIG. 3 shows an equivalent circuit diagram of a MEMS microphone comprising an amplifier having a balanced input port.

FIG. 3 shows a double backplate microphone DBM comprising an amplifier AMP having two balanced input ports: a first balanced input port BIP1 and a second balanced input port BIP2. The first balanced input port BIP1 is electrically connected with the first backplate BP1 of the first capacitance element C1. The second balanced input port BIP2 is electrically connected to the second backplate BP2 of the second capacitance element C2. The membrane M is biased via a membrane input port. As both backplates of the capacitance element CE are electrically connected to the amplifier AMP, the capacitance element CE needs, in addition to the membrane biasing port MBP, a first backplate output port BOP1 and a second backplate output port BOP2.

Assuming the capacitances of the capacitors and the parasitic capacitances equal the respective capacitances of the embodiment of FIG. 2, then the differential effective sensing voltage is given by:

$$V\text{diff}=V2*C2/(C2+Cp2)+V1*C1/(C1+Cp1) \text{ tm } (2)$$

Thus, Vdiff=0.788*Vsens. Thus, the sensing efficiency of a microphone comprising an amplifier having a single-ended input—compare equation (1)—is decreased by a factor of 0.714/0.788=0.9 with respect to a double backplate microphone with a balanced amplifier input.

However, the sensing efficiency compared to single backplate microphones is improved and manufacturing costs and current consumption compared to microphones comprising an amplifier having a balanced input port are reduced.

Figure 4:
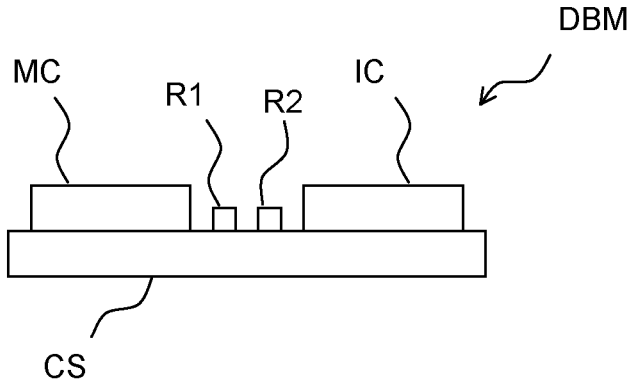
FIG. 4 shows a double backplate microphone comprising a carrier substrate carrying a MEMS chip, an IC chip, and two resistive elements.

FIG. 4 shows an embodiment of a double backplate microphone DBM where a carrier substrate CS carries a MEMS chip MC, resistive elements R1 and R2, and an IC chip IC. The mechanical components, especially the backplates BP1, BP2, the membrane M and the back volume are arranged within the MEMS chip MC. The circuit elements of the amplifier are integrated within the IC chip which can be an ASIC chip.

A double backplate MEMS microphone is not limited to the embodiments described in the specification or shown in the figures. Microphones comprising further elements such as further backplates, membranes, capacitive or resistive elements or amplifiers or combinations thereof are also comprised by the present invention.

A high bias voltage is applied to the membrane while the lower backplate and the upper backplate are both biased at a common mode voltage via a resistive element such as a very high impedance bias network. The biasing voltage is chosen to be a suitable input bias point for the amplifier. Thus, the microphone is biased at an effective bias voltage of V2−V1. When subjected to sound pressure, it will generate opposite phase signals as the respective balanced output ports BOP1 and BOP2. This differential signal will be amplified in the amplifier providing a single-ended output voltage.

LIST OF REFERENCE SIGNS

AMP: amplifier
BIP1: first balanced input port
BIP2: second balanced input port
BOP1: first balanced output port
BOP2: second balanced output port
BP1, BP2: first, second backplate
C1, C2: first, second capacitor
CE: capacitance element of (timely) variable capacitance
CM: parasitic capacitance between the membrane and ground
CP1: parasitic capacitance between the first capacitor and ground
CP2: parasitic capacitance between the second capacitor C2 and ground
CS: carrier substrate
DBM: double backplate microphone
GND: ground
IC: IC chip
M: membrane
MBP: membrane bias port
MC: MEMS chip
R1: first resistive element
R2: second resistive element
SEIP: single-ended input port of the amplifier
SEOP: single-ended output port
VS1: first voltage source
VS2: second voltage source

The invention claimed is:

1. A double backplate microphone, comprising
a micro-electro-mechanical system (MEMS) chip,
an amplifier with an single-ended input port,
a first backplate, electrically connected to the single-ended input port,
a second backplate electrically connected to ground,
a membrane, arranged between the first and the second backplate,
a first resistive element having a resistance >=1 GΩ and electrically connected to the first backplate,
a second resistive element having a resistance >=1 GΩ and electrically connected to the membrane,
a first capacitance C1 between the first backplate and the membrane,
a second capacitance C2 between the second backplate and the membrane,
a parasitic capacitance Cp1 between the first backplate and ground,
a parasitic capacitance Cm between the membrane and ground,
a parasitic capacitance CP2 between the second backplate and ground, where
4 pF<=Cm=C1=C2<=8 pF,
Cp1=0.1*C1,
Cp2=0.5*C1,
the first backplate, the membrane, and the second backplate are arranged on the MEMS-chip.

2. The double backplate microphone of claim1, where
the first backplate is biased with a voltage between −2 V and +2 V.

3. The double backplate microphone of claim 1, where
the membrane is biased with a voltage V1 relative to the first backplate,
the membrane is biased with a voltage V2 relative to the second backplate, and
5 V<=V1=V2<=15 V.

4. The double backplate microphone of claim 1, where the amplifier is a low noise amplifier.

5. The double backplate microphone of claim 1, further comprising a carrier substrate and a IC-chip, where
the amplifier comprises amplifier circuits arranged in the IC-chip,
the MEMS-Chip and the IC-chip are arranged on the carrier substrate.

6. The double backplate microphone of claim 1, further comprising a MEMS-chip, where
the first backplate, the membrane, and the second backplate are arranged on the MEMS-chip,
the amplifier comprises amplifier circuits arranged in the MEMS-chip.

7. The double backplate microphone of claim 1, where the first resistive element and the second resistive element are realized as surface-mounted device (SMD) components.

8. The double backplate microphone of claim 1, where the first resistive element and the second resistive element are realized in an IC chip.

* * * * *